US006017163A

United States Patent [19]

Keppers et al.

[11] Patent Number: 6,017,163

[45] Date of Patent: Jan. 25, 2000

[54] FLOOR FINISH DISTRIBUTION APPARATUS

[75] Inventors: Roger W. Keppers, St. Paul; James L. Copeland, Apple Valley; James R. Johnson, Bloomington; James D. Decker, Apple Valley, all of Minn.

[73] Assignee: Ecolab, Inc., St. Paul, Minn.

[21] Appl. No.: 09/022,317

[22] Filed: Feb. 11, 1998

[51] Int. Cl.[7] ..... A46B 11/00

[52] U.S. Cl. ..... 401/48; 401/282; 401/270; 15/321

[58] Field of Search ..... 401/48, 268, 270, 401/282, 283, 284, 137, 139, 146; 15/321, 320, 322

[56] References Cited

U.S. PATENT DOCUMENTS

| | | | |
|---|---|---|---|
| D. 152,249 | 1/1949 | Fox . | |
| D. 158,876 | 6/1950 | Lowell . | |
| D. 330,103 | 10/1992 | Andrews, Jr. et al. | D34/20 |
| D. 381,166 | 7/1997 | Bonazza | D34/20 |
| 1,778,552 | 10/1930 | Floyd . | |
| 2,053,282 | 9/1936 | Gewalt | 91/25 |
| 2,061,216 | 11/1936 | Thompson | 91/25 |
| 2,721,662 | 10/1955 | Miller | 211/71 |
| 2,731,656 | 1/1956 | Payne | 15/128 |
| 2,865,647 | 12/1958 | Wilson | 280/47.35 |
| 2,875,463 | 3/1959 | Minerley | 15/139 |
| 3,346,271 | 10/1967 | Parsons | 280/33.99 |
| 3,573,879 | 4/1971 | Bergkamp et al. | 280/47.19 |
| 4,119,386 | 10/1978 | Cushing | 401/138 |
| 4,397,057 | 8/1983 | Harbeck | 15/321 |
| 4,471,713 | 9/1984 | Cote et al. | 118/108 |
| 4,597,124 | 7/1986 | Williams, III et al. | 8/158 |
| 4,893,375 | 1/1990 | Girman et al. | 15/321 |
| 4,910,828 | 3/1990 | Blase et al. | 15/321 |
| 4,971,471 | 11/1990 | Sloan | 401/203 |
| 4,984,328 | 1/1991 | Berfield | 15/322 |
| 4,989,291 | 2/1991 | Parent | 15/315 |
| 5,040,811 | 8/1991 | Busken et al. | 280/47.34 |
| 5,134,748 | 8/1992 | Lynn | 15/321 |
| 5,331,713 | 7/1994 | Tipton | 15/320 |
| 5,343,591 | 9/1994 | Clark | 15/322 |
| 5,555,597 | 9/1996 | Berfield | 15/321 |
| 5,784,753 | 7/1998 | Kaczmarz et al. | 15/321 |
| 5,815,881 | 10/1998 | Sjogreen | 15/321 |

OTHER PUBLICATIONS

Instruction Manual for K–200 E–Z Way™ Applicator For Solvent Seals.

Product Brochure for WAX WHIZ™ Floor Finish Applicator (Presumed Date Sep. 1, 1993).

*Primary Examiner*—David J. Walczak

*Attorney, Agent, or Firm*—Merchant, Gould, Smith, Edell, Welter & Schmidt, P.A.

[57] ABSTRACT

A liquid floor finish application applicator comprising a mobile unit and a wand unit. The mobile unit comprises a handle and wheels. In the cart is positioned one or more sources of floor finish, and a pump for delivering the floor finish to a length of liquid conduit. The wand comprises a distribution head typically a mop installation. The wand also comprises a spray head that can deliver the liquid floor finish to the floor. The conduit is in liquid communication with the wand. The spray head is configured to avoid dripping between finish application. The drip free head results from the aperture size of the spray aperture surface. The lengthy conduit between the cart and the wand permits ease of application by a two man team. A first man operates the cart while a second man operates the wand.

11 Claims, 3 Drawing Sheets

FLOOR FINISH DISTRIBUTION APPARATUS

FIELD OF THE INVENTION

The invention relates to a portable or wheeled mobile apparatus that can be used to distribute a liquid floor finish on a large floor surface having a wood, concrete or composite surface. The apparatus is adapted for aqueous floor finishes that are distributed in a thin wet layer. The thin layer dries leaving a matte or shiny, robust wear resistant surface finish. The apparatus is adapted to applying finishes to large area floors efficiently using a two man team.

BACKGROUND OF THE INVENTION

The application of aqueous floor finishes to large surface areas remains a difficult problem for floor maintenance personnel. The application of floor finishes is commonly conducted by a simple manual application of floor finish accompanied by a manual spreading. Such manual application is often done by simply pouring liquid typically aqueous floor finish from a container and spreading the floor finish with a mop or squeegee device. Such an application is messy, difficult to control, and can result in uneven application of the floor finish leaving portions of the floor incompletely covered with other portions having excess finish. Such manual applications are also time consuming and uneconomic.

In the prior art we have found that mobile or portable floor treatment apparatus are typically divided into two separate art classifications. A first classification is mobile floor cleaning equipment, while a second application relates to portable floor finish apparatus. The prior art typically discusses floor "waxes" in a floor finish context. "Waxes" are an obsolete sub-set of finishes; the term wax is sometimes used incorrectly as a synonym for floor finish. Floor waxes are formulated for home and commercial realty floor finishing and are typically not a finish that falls within the scope of the invention. Further, floor cleaning systems in the prior art are substantially different than the floor finish systems of the invention. Such floor cleaning systems, typically in a step wise procedure, apply a cleaner, removes the cleaner and applies a rinse, removes the rinse and may apply a finishing wax coating. The floor finish system of the invention is primarily adapted to an even distribution of a floor finish over a large area floor from an aqueous material leaving a dried shiny attractive, uniform and durable floor coating.

Gewalt (U.S. Pat. No. 2,053,282), Thompson (U.S. Pat. No. 2,061,216), Payne (U.S. Pat. No. 2,731,656), Minerley (U.S. Pat. No. 2,875,463) and Cushing (U.S. Pat. No. 4,119,386) disclose an apparatus typically characterized in the prior art as "a fountain mop." Such systems comprise typically a wand having mounted thereon, a reservoir for an aqueous material that can be applied through a "fountain" and a mop head that can be used to distribute the aqueous material. Similar to such fountain mops, Floyd (U.S. Pat. No. 1,778,552), Burfield (U.S. Pat. No. 4,984,328) and Sloan (U.S. Pat. No. 4,971,471) each teach a mop or brush head that includes a spray system for introducing an aqueous material into the head or on a floor.

One common configuration of a typical mobile floor cleaning system is the portable or motor driven cleaning machine such as that shown in Girman et al. (U.S. Pat. No. 4,893,375) or Tipton (U.S. Pat. No. 5,331,713) these apparatus are configured to sequentially apply cleaning materials to a floor, scrub the floor and then remove the cleaning materials for further operations. A brief review of these disclosures show that no system is available that is adapted for the convenient, efficient application of a liquid floor finish over a large area floor using a portable cart system. The larger portable or motor driven systems are adapted for the serial application and removal typically by vacuum systems of aqueous materials used to wash, rinse or coat floor surfaces.

A substantial need exists for a useful efficient floor finish applicator.

BRIEF DESCRIPTION OF THE INVENTION

The improved applicator device of the invention is a liquid floor finish applicator cart with an associated applicator/distributor wand connected with a long conduit or tube. The cart has a mobile central unit comprising a wheeled base and a handle for easy portability. The mobile central unit also comprises a source of floor finish that can be deliverable through a liquid conduit to the applicator. The source of floor finish can comprise one or more bottles adapted to the mobile central unit. The contents of the bottles can be delivered to the conduit means using an appropriately sized and configured pump. The pump can be energized using electric storage devices, typically rechargeable batteries. The liquid floor finish is typically delivered through the conduit to a wand apparatus. The wand comprises a floor finish distribution means and spray head. The floor finish distribution means typically involves a flat mop or string mop head adapted to forming a uniform coating of the liquid floor finish on a large floor surface. The spray head is used to deliver the liquid floor finish to the floor for distribution using the distribution means. The spray head is a non-drip spray head. The spray head is made non-drip using an apertured surface wherein the apertures have a diameter dimension of about 0.5 to 5 mm and a hole depth of 1 to 10 mm. The surface tension of the floor finish cooperates with the aperture size to prevent dripping during the time between spray of the floor finish. The floor finish system is adapted to liquid floor finishes and the application of the floor finish through a floor. The mobile unit is free of systems that remove liquid from a surface such as vacuum pickups and other such negative pressure or capillary action apparatus. The typical liquid floor finishes are aqueous dispersions of urethane, acrylic or other polymeric materials. For the purpose of this application, the term "cart" is directed to a mobile wheeled unit having two or more wheels disposed on an axle separated by at least 20 cm and a handle for easy mobility or portability of the cart unit. The cart of this application is not motorized for movement and is simply moved by an operator. The applicator cart is typically operated by a two man team. A first man moving the applicator cart. A second operating the wand and the spray head to ensure an even application of a finish coating on the floor. The term "drip-free" relates to a spray head that does not release substantial or unwanted amounts of finish when the aqueous finish controller is not actuated for flow of finish.

DETAILED DESCRIPTION OF THE INVENTION

Figure 1:
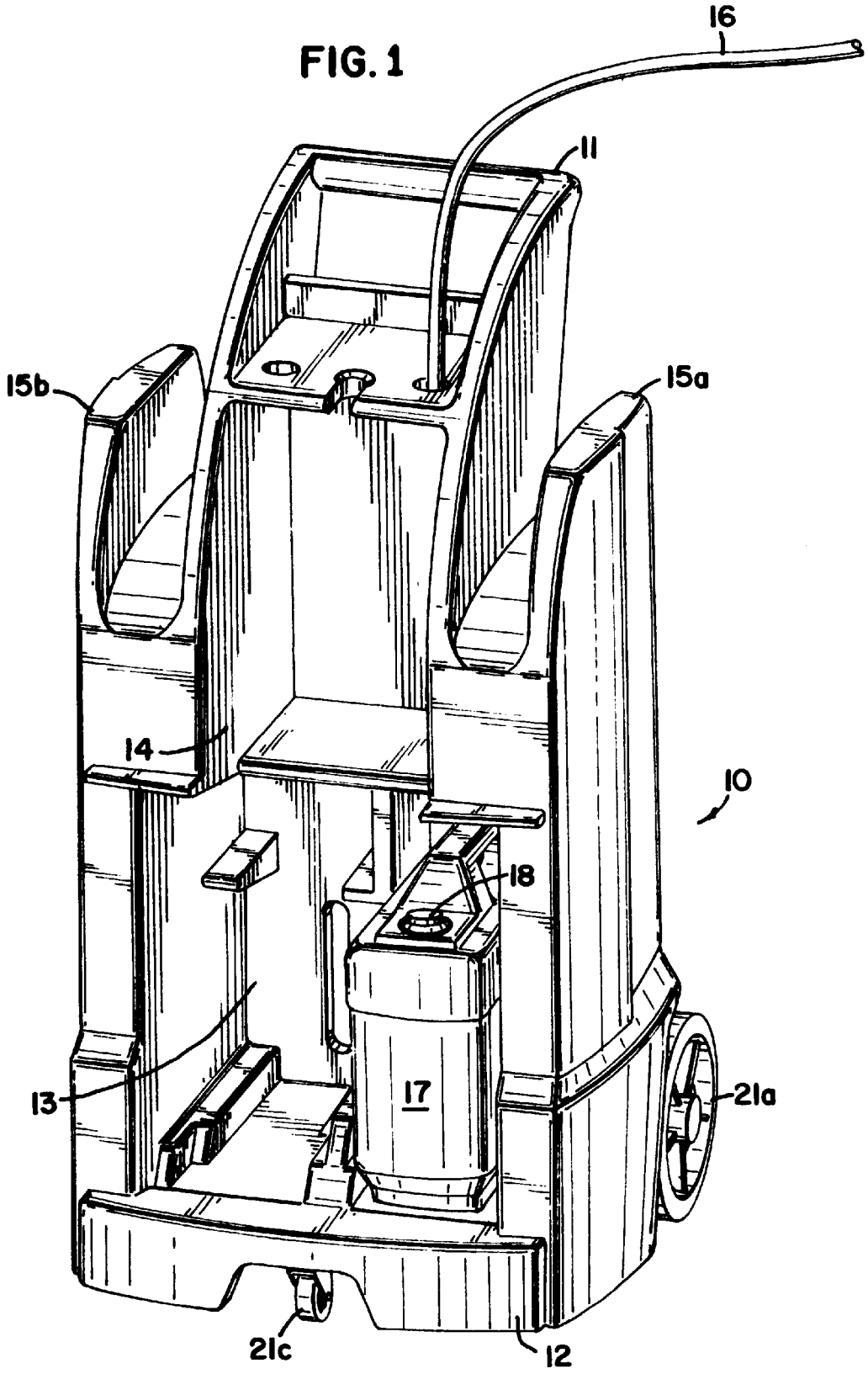
FIG. 1 shows the cart, conduit and wand or distribution means for the floor finish system. The wand or distribution means comprises a spreader and a spray applicator.

The floor finish applicator comprises a mobile central unit. The mobile central unit is a preferably unitary molded unit having the handle and mounting locations for one or more bottles or containers and pump means for the liquid floor finish, and a source of power such as a rechargeable battery. The mobile central unit can be manufactured from common thermoplastic materials or thermoplastic composites. Typical thermoplastics include polyethylene, polypropylene, polyvinylchloride and polyester. Thermoplastic composites can contain reinforcing fibers such as glass fiber, metal fiber, polyimide fiber, etc. The units are a molded unit and typically has a handle mounted on the unit. The unit can be moved to location for easy mobility of the wheeled unit. The unit is made portable by two or more wheels mounted on an axle associated with the unit. The wheels are typically mounted at a distance apart of about 20 cm typically 70 to 80 cm. The applicator cart typically has a recessed portion or site for mounting a pump, battery, pump controller and utility racks; other recessed sites are designed for the placement or storage of one or more bottles of floor finish. The floor finish containers are fluidly connected to the pump mechanism through fluid tight connectors that are configured to empty the containers efficiently.

Such bottles are roughly a rectangular prism having means for access for a conduit adapted to draw the liquid finish from the bottle to the pump. Such bottles typically have a volume of at least 2 liters and can be 2 to 25 liters. Typically two or more bottles of similar or complementary formulations are positioned within the cart and are nested or communally arranged in a recessed mounting location. The bottles can be fixed within the cart using commonly available attachment hardware. The bottles can be provided with lids that can be removed for the purpose of inserting the conduit means to the pump, however, the bottle lids can also contain a dip tube that can lead from a fitting in the lid to the bottom of the bottle. The lid fitting can be adapted for attachment to the conduit means. Further, the bottles can contain a dip tube molded into the side of the bottle having a fitting adapted to the conduit means.

The applicator cart also contains a pump means in liquid communication with the bottle and further in liquid communication with a conduit that can direct the liquid floor finish to the wand distribution means. The variable speed means typically has a liquid input and a liquid output, a switch or power controller and a source of power. The pump typically comprises an apparatus that can deliver about 200 to 500 mL of floor finish per minute at a pressure of at least 60 psig for a period of time greater than about 10 minutes. Such pumps typically weigh less than about 10 pounds.

The pump is energized by a rechargeable battery. Such batteries can comprise a lead acid battery, a gelled lead acid battery, a lithium battery, a Ni/Cd battery, or other commonly available rechargeable batteries. Such batteries have a electric storage capacity of at least about 2 amp hours, preferably about 2 to 20 amp hours for efficient floor finish. The battery should retain sufficient electric power to enable the application team to treat a floor of at least 1000 $ft^2$ preferably about 1000 to 100,000 ft with a typical floor finish material. Tubing interconnecting the bottles, with pump, and the conduit can comprise any commonly available rigid, semi-rigid or flexible tubing material. Selection of this material is left to the design engineer.

The wheeled cart of the invention is roughly a rectangular prism having a base wheeled unit and a top handled portion with indented storage locations for the bottles, pump and battery within the rectangular prism. The organization of the interior of the cart is left to the ordinary skilled engineer. However, the preferred organization places the floor finish bottles in the base of the unit separate from the electrical apparatus. The electrical apparatus is preferably arranged within the unit above the bottles of floor finish and isolated from the liquid materials using a barrier that can be molded into the cart apparatus. The barrier and walls associated with the cart can provide mounting locations for the battery or batteries, the pump and electrical control switches and plugs.

The storage battery used in the cart can be recharged in the cart by plugging the cart into a wall outlet or by plugging a charger cord from a wall outlet into a plug integrally molded into the wall of the housing. Alternatively, the battery or batteries can be removed from the cart and inserted into a charger unit which can introduce sufficient electrical power into the batteries for an efficient floor coating session.

The wheeled cart of the invention is connected with the wand using a flexible conduit or tubing. The tubing is adapted for flow of the liquid floor finish from the cart to the wand without sufficient pump load or delay. The internal diameter of the conduit is typically about 3 to 15 mm and the length of the conduit is typically greater than about 5 meters and preferably greater than about 25 meters. The length of conduit permits efficient dispensing of the liquid floor finish and distribution of the floor finish on a large surface without excessive movement of the cart. A close association of the wand with the cart with a short conduit would reduce efficiency and reduce the quality of the resulting coating. The flexible tubing can be made from typical flexible tubings including materials such as urethane and other commonly available tubing materials.

The conduit is typically attached to an applicator wand comprising an aqueous finish distribution means and an aqueous spray head. The conduit is typically connected directly through a valve to a tube leading to the spray head. The spray head typically comprises an area of about 100 to 1000 $mm^2$ having throughout this area an apertured surface that can uniformly distribute the floor finish in a spray form. Such apertured surface can comprise a screen with a wire diameter of 0.5 to 0.1 millimeters and a distance between the wires of about 2.0 to 0.1 mm. Alternatively, the apertured surface can comprise a thermoplastic disk having holes drilled or molded in the disk. The diameters of the holes can be about 0.5 to 5 mm with a separation between the centers of the holes at least of about 0.5 mm, preferably about 0.5 to 1.0 mm. The preferred spray head comprises an opening having an area of about 200 to 500 $mm^2$ and with holes of about 0.7 to 2.0 mm in diameter and 1.0 to 10 mm in depth. The spray head is mounted on a wand attached to distribution means for the floor finish. The wand is typically a linear member having a circular cross section of about 3 to 13 mm and a length of about 0.5 to 5 meters.

Valves useful in controlling the flow of the aqueous materials of the invention are conventional mechanical valves. Preferably the valve can be molded in a single unit with the linear member and spray head. The valve can have a detent position that maintains a flow while on the detent without operation by the floor finisher. The valve can also have a position for flow only while maintained in that position by the floor finisher.

The wand is attached to a distribution means for the floor finish. Distribution means typically comprises a mop head or an applicator device. Mop heads typically comprise a plurality of flexibility fibrous units that can absorb and distribute the floor finish. Applicator devices typically comprise a flexible web attached to a mounting frame. The web is typically has a width of 5 to 20 cm and a length of about 30 to 75 cm. The flexible squeegee web can easily distribute the floor finish in a controllable thickness resulting in a shiny durable floor coating.

Aqueous compositions suitable for use with the application cart of the invention are typically aqueous dispersions or suspensions of organic polymeric materials. The floor finish comprises water carried coatings including conventional aqueous base polish compositions, either non-buffable, self-polishing or buffable types, temporary protective coatings, clear aqueous rust retardant coatings, etc. These coatings dry to a substantially clear film and include non-volatile, solid film formers dispersed in the aqueous base with an emulsifying and dispersing agent for dispersing the film former in the aqueous phase or base. The emulsifying and dispersing agent, which preferably is anionic or nonionic, serves a well known function and is present in an amount sufficient to form a stable dispersion of the film former in the aqueous base and permits the film former to deposit therefrom upon evaporation of the water. The term "dispersion" as used herein broadly encompasses systems wherein the film former is uniformly dispersed throughout the aqueous phase as an emulsion, as a colloidal suspension, as a solute, or a combination thereof, e.g., partially in solution and partially in emulsion form.

As is well known in the art, various other ingredients can be included in aqueous base floor finish or polish compositions and temporary protective coatings, such as plasticizers to facilitate film formation at room temperature and/or improve flexibility, surfactants or wetting agents to further facilitate the deposition of a smooth, continuous film and alkali-soluble resins to facilitate eventual removal of the film and/or improve gloss. The film former used generally can be any conventional non-volatile, solid film-formers which are emulsifiable or dispersible in conventional emulsifying and dispersing agents including waxes, synthetic polymers, natural and synthetic resins, particularly alkali-soluble resins, and mixtures thereof.

Representative examples of suitable natural and synthetic resins and polymers include shellac, polyvinyl acetate, polyvinyl chloride-acetate, polyvinyl chloride, thermoplastic urethane polymers, copolymers of vinylidene chloride and acrylonitrile, terpene resins, terpene phenolic resins, copolymers of vinyl acetate and crotonic acid, copolymers of butadiene and styrene, polyvinylidene chloride, polyacrylates, shellac-modified polystyrenes, terpolymer latexes of the type disclosed in U.S. Pat. No. 3,406,133, acrylic interpolymers of the type disclosed in U.S. Pat. No. 3,429,842, and metal complexed or ionic-crosslinked polymers of the type disclosed in U.S. Pat. Nos. 3,808,036 and 3,467,610, particularly acrylic copolymers which are ionic-crosslinked with a water-soluble polyvalent metal compound, such as zinc or zirconium. Interpolymers or copolymers and mixtures thereof are the preferred synthetic polymer film formers because of their high detergent resistance, better recoating properties and ease of removal with an alkaline cleaner or stripper composition.

Many synthetic polymer film formers are commercially available as emulsions or dispersions which can be included as part of the coating composition as is without the addition of any further emulsifying and dispersing agents. Representative examples of such commercially available acrylic polymer and copolymer emulsions or dispersions include, Rhoplex B-1162, supplied by Rhom and Hass Company, Esi-Cryl Beyond and Esi-Cryl respond supplied by Cook Composites and Polymers Co., Syntron 1292 and Syntron 1295 supplied by Interpolymer Corporation, and ML-870 and Conlex IV supplied by Morton International. Similarly, many alkali-soluble synthetic resins are commercially available as emulsions or dispersions, such as Acrysol 527 supplied by Rohm and Haas Company, which can be included as part of the polish composition as is without the addition of any further emulsifying and dispersing agents.

The coating composition preferably is compounded by admixing commercially available aqueous emulsions or dispersions of the film former, both the resin or synthetic polymers and wax when used, with water in any convenient manner. The total amount of each dispersion in water is adjusted to provide the solid content desired in the final product, which usually is within the range of about 8 to 45 weight %, preferably about 12 to 20 weight % based on the total weight of the composition.

To facilitate film formation, conventional plasticizers can be included in the composition. Permanent plasticizers, if used in the relatively large proportions, may tend to decrease the wear resistance and water resistance of the resulting film. Therefore, they should be used in relatively small amounts, i.e., up to not more than about 5 weight %, based on the total weight of the composition. Representative examples of suitable fugitive plasticizers include high boiling alcohols and their ethers, such as monoethyl or monomethyl ether of diethylene glycol (Carbitol), ethylene glycol, diethylene glycol, isophorone, benzyl alcohol, and 3-methoxybutanol-1. Representative examples of suitable essentially permanent plasticizers include benzyl butyl phthalate, dibutyl phthalate, dimethyl phthalate, triphenyl phosphate, triethyl phosphate, tributyl phosphate, 2-ethyl hexyl benyl phthalate, butyl cyclohexyl phthalate, mixed benzoic acid and fatty acid esters of pentacrythritol, poly-(propylene adipate) dibenzoate, diethylene glycol dibenzoate, tetrabutylthiodisuccinate, butyl phthalyl butyl glycolate, acetyl tributyl citrate, dibenzyl sebecate, tricresyl phosphate, toluene ethyl sulfonamide the di-2-ethylhexyl ester of hexamethylene glycol diphthalate, di-(methylcyclohexyl) phthalate, tributoxyethyl phosphate, and tributyl phosphate. The particular plasticizer and the amount thereof used are chosen in accordance with the demand for compatibility and efficiency in lowering the film-forming temperature. Some plasticizers, such as tributoxyethyl phosphate, also serve as leveling agents.

Optional minor ingredients customarily used in the art can be added to the coating composition including surfactants or wetting agents, such as the fluorocarbon surface active agents disclosed in U.S. Pat. Nos. 3,163,547 and 2,937,098, anti-foaming agents, preservatives, such as formaldehyde, and fragrance additives when required to mask the odor of certain plasticizers. When wetting agents are used, the amount thereof should be kept to a minimum because of their tendency to cause foaming. Generally, amounts less than about 1.0 weight %, offers best results. While the coating composition of the invention can be used for a wide variety of applications, it is particularly suitable as a household floor polish for lighter-colored resilient floor coverings, such as linoleum and asphalt, vinyl and vinyl-asbestos tile and as a temporary protective film for articles, such as kitchen utensils, and a temporary corrosion-resistant film for metals which are to be subsequently treated.

Useful formulations for the floor finish include commercial finishes such as LASER® and GEMINI® and the following typical formulae:

| PERCENT (%) | DESCRIPTION |
|---|---|
| 54.82 | Water |
| 0.03 | Fluorocarbon Surfactant |
| 0.02 | Defoamer |
| 4.06 | Diethylene Glycol Monomethyl Ether |
| 1.17 | Tributoxyethyl Phosphate |
| 0.51 | Dibutyl Phthalate |
| 0.15 | Formaldehyde (Active Aqueous) |
| 30.52 | Acrylic Styrene Copolymer Emulsion (40% Active Aqueous) |
| 2.90 | Low Molecular Weight Acrylic Resin (25% Active Aqueous) |
| 5.82 | Polyethylene Emulsion (40% Active Aqueous) |

DETAILED DESCRIPTION OF THE DRAWINGS

FIG. 1 is a view of the wheeled cart 10 of the invention having a handle 11 and a base unit 12 with wheels 21*a* and 21*c*. The cart has a first recessed mounting location 13 for generally rectangular bottles of floor finish. The cart also has a recessed mounting location 14 suitable for holding a utility rack (not shown) or a wire storage rack (not shown). The cart of the invention has shoulder extensions 15*a* and 15*b* that can be used to store coiled lengths of conduit 16 that delivers liquid floor finish from the cart to the wand apparatus (not shown). FIG. 1 shows a single bottle 17 in the recess 13. The bottle has an opening 18 which can be closed with a lid and which can also be used, without the lid, to introduce a conduit or tubing that can be used to draw the liquid floor finish from the bottle to the pump and vents into the conduit for delivery to the wand.

Figure 2:
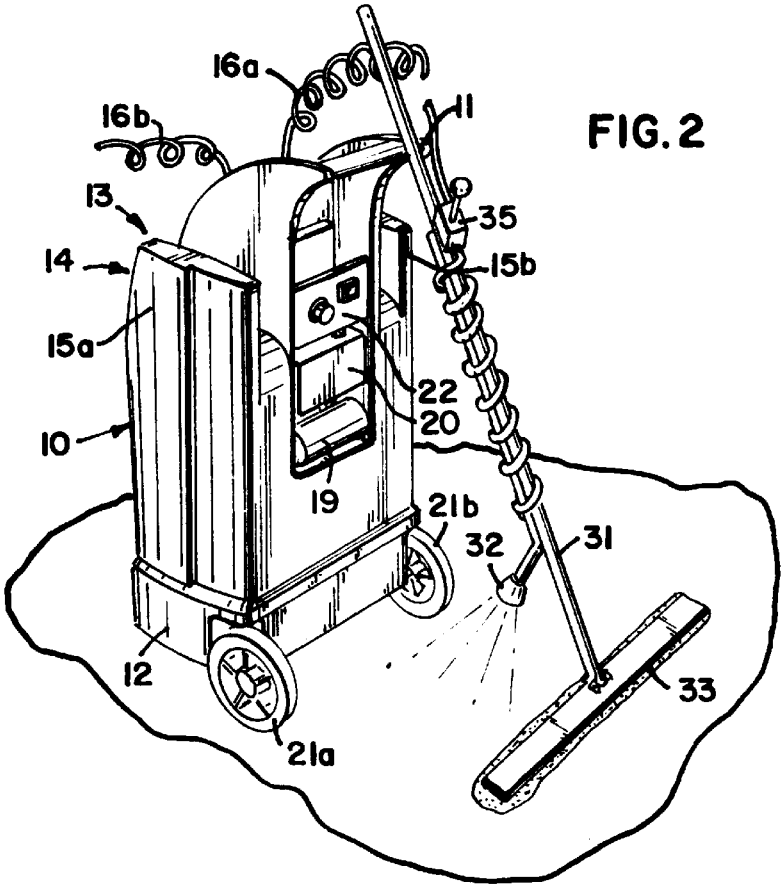
FIG. 2 is a detailed view of the cart.

FIG. 2 shows the side of the applicator cart now shown in FIG. 1. In FIG. 2 the cart 10 is shown with a wheeled base 12 having wheels 21*a* and 21*b* for ease of transportation. The cart has a recessed opening suitable for attachment of an electrical pump 19, a rechargeable storage battery 20 and a control unit 22. The cart can contain a source of one, two, or more different finished materials. In such case, the cart can have one, two or more separate conduits 16*a* or 16*b*. One conduit for each coating material. FIG. 2 also shows the wand assembly 30.

Figure 3:
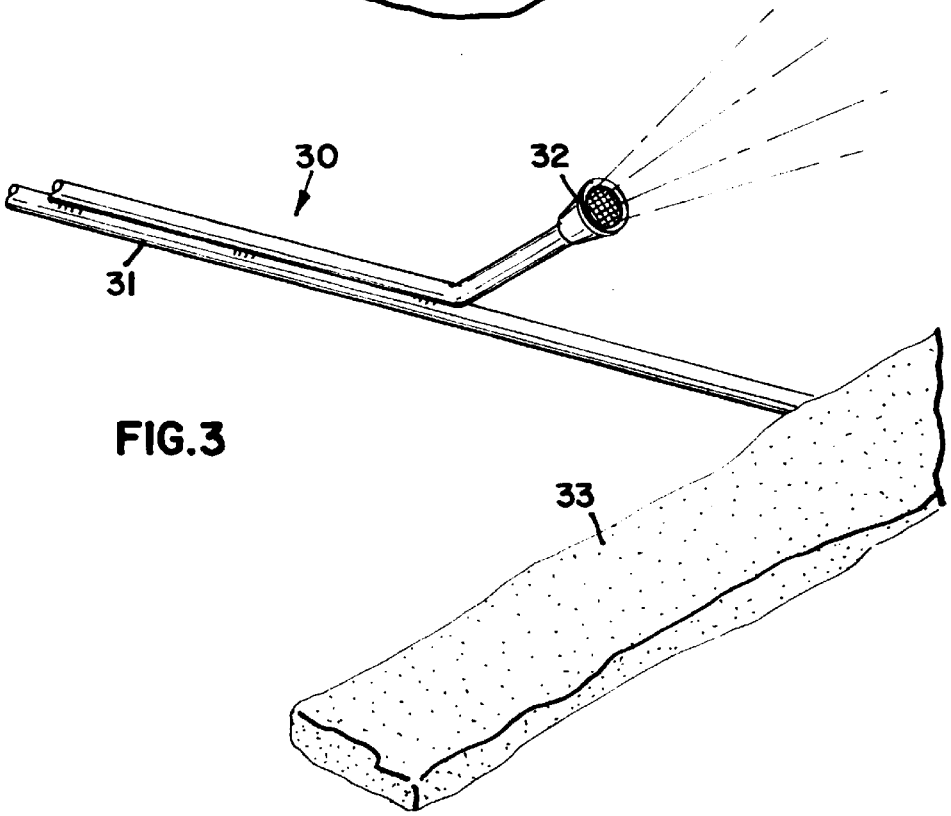
FIG. 3 is a detailed view of the wand or distribution means comprising a spreader and spray for the finish.

FIG. 3 is a view of the wand assembly 30 of the invention. The wand comprises a linear member (handle) 31, a spray head 32 and application means 33. The linear member 31 comprises a long handle or tube that can be used to position and move the distribution means 33 relative to the floor surface. On the linear member 31 is attached the distribution means 33 which can comprise a mop head or application.

In the operation of the unit, a valve or flow control 35 is open to permit flow of finish to the spray head 32. When sufficient finish is delivered, the valve 35 is closed and the floor finish is distributed until consumed at which time the valve can be operatively delivered to deliver additional finish to the floor for distribution.

Figure 4:
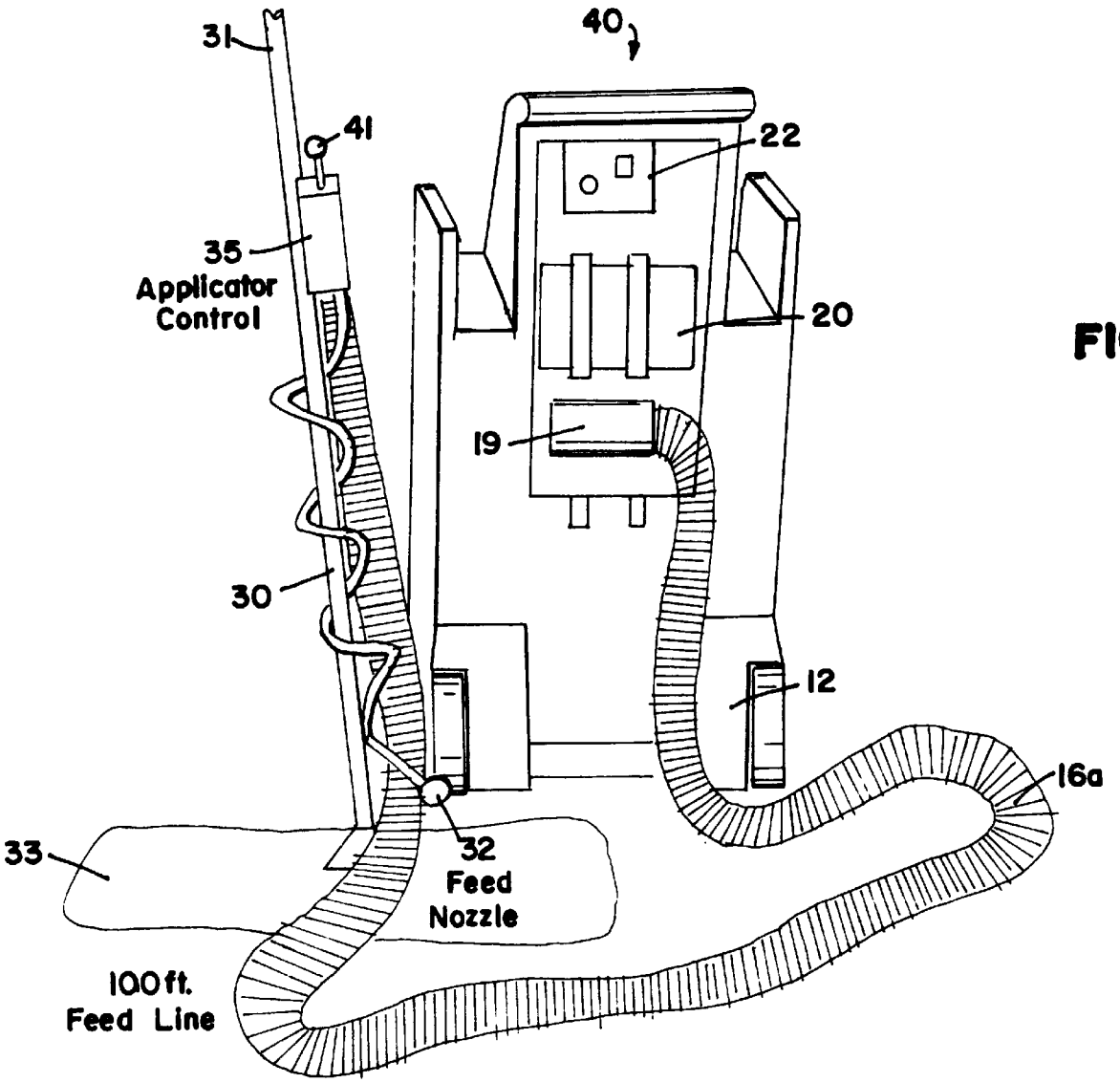
FIG. 4 shows the two wheeled cart with power pump and control box; about 100 feet of conduit and wand or distribution means for the floor finish system. The wand or distribution means comprises a controller valve, spreader and a spray applicator.

FIG. 4 is similar to FIG. 2 in that FIG. 4 shows the entire system. In FIG. 4 the applicator system 40 comprises a two wheeled cart 12 and an associated wand 30, spout (spray head) 32 and distribution means 33. The flow of liquid from the system 40 is accomplished using a battery 20 that energizes a pump 19 controlled by a controller 22. The battery 20 is typically a rechargeable battery that can be charged using conventional plug in devices. The controller 22 can control the pump speed of pump 19 and can control the activation of the pump. The applicator system 40 is conveniently used with a length of flexible tubing 16*a* attached between the pump outlet and the applicator to deliver finish liquid from pump 19. The liquid is typically obtained from a container 17 (see FIG. 1). The source of the liquid is simply a tube pick up (not shown) in direct liquid communication with pump 19. The valve (applicator control) 35 controls delivery of finish through feed nozzle (spray head) 32. The applicator control handle 41 can have a full on position at which time the floor finish is continually delivered through the nozzle 32. The applicator control handle 41 can also have temporary on positions that dispense finish only when held in the on position. The full on position includes a detent feature that maintains the handle in the on position until moved to the off position. The wand 30 includes a handle, 1 and a distribution means (mop head) 33. As finish is delivered from nozzle (spray) 32, the mop head 33 distributes the finish evenly on the floor surface.

The specification and drawings of the application provide a basis for understanding the operation of the invention and disclose the best mode. The invention can be embodied in a variety of configurations of the disclosed parts and can be arranged in a variety of configurations and schemes. Since the invention can be embodied in a variety of different configurations, the invention resides in the claims hereinafter appended.

We claim:

1. A liquid floor finish applicator cart comprising:

(a) a mobile central unit comprising a handle, portability means and, a source of floor finish deliverable through a liquid conduit means having a length of greater than 15 meters; and (b) a wand apparatus comprising a floor finish distribution means and a spray head, the spray head in a valved liquid communication with the liquid conduit means, the spray head comprising a substantially drip-proof apertured surface, the apertures having a major diameter of about 0.5 to 5 mm and a hole depth of 1 to 10 mm; wherein the system is flee of a vacuum pickup.

2. The applicator of claim 1 wherein the liquid conduit means is a flexible tube with an internal diameter of 3–15 mm.

3. The applicator of claim 1 wherein the source of floor finish comprises a reservoir and a variable speed pump.

4. The applicator of claim 3 wherein the reservoir comprises a plastic bottle having a volume greater than about 2 liter.

5. The applicator of claim 3 wherein the reservoir comprises two separate bottles each bottle having a volume independently selected from a volume greater than about 2 liters.

6. The applicator of claim 3 wherein the pump has a capacity of about 200–500 mL per minute.

7. The applicator of claim 1 wherein the distribution means comprises a mop head having a length of at least about 10 cm.

8. The applicator of claim 1 wherein the apertured surface comprises a disk having drilled or molded apertures with a diameter of about 0.5 to 5 mm.

9. The applicator of claim 1 wherein portability means comprises: at least two wheels positioned on an axle at a distance of greater than 30 cm.

10. The applicator of claim 1 wherein the applicator is adapted to the aqueous floor finish.

11. The applicator of claim 1 wherein the applicator is adapted to an aqueous polyurethane floor finish, an aqueous acrylic floor finish or mixtures thereof.

* * * * *